US010020144B2

(12) United States Patent
Rival et al.

(10) Patent No.: US 10,020,144 B2
(45) Date of Patent: Jul. 10, 2018

(54) MULTIPOLAR AIR-BREAK CIRCUIT BREAKER INCLUDING AN IMPROVED DEVICE FOR FILTERING QUENCHING GAS

(71) Applicant: Schneider Electric Industries SAS, Rueil-Malmaison (FR)

(72) Inventors: Marc Rival, Saint Ismier (FR); Eric Domejean, Voreppe (FR); Jean-Paul Gonnet, Fontaine (FR); Nicolas Chaboud, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/296,378

(22) Filed: Oct. 18, 2016

(65) Prior Publication Data

US 2017/0169972 A1 Jun. 15, 2017

(30) Foreign Application Priority Data

Dec. 10, 2015 (FR) ..... 15 62144

(51) Int. Cl.
*H01H 33/62* (2006.01)
*H01H 9/34* (2006.01)
(Continued)

(52) U.S. Cl.
CPC ..... *H01H 33/62* (2013.01); *H01H 9/342* (2013.01); *H01H 73/18* (2013.01); *H01H 2201/024* (2013.01)

(58) Field of Classification Search
CPC ..... H01H 33/62; H01H 33/08; H01H 33/20; H01H 9/34; H01H 9/342; H01H 73/18
(Continued)

(56) References Cited

U.S. PATENT DOCUMENTS 3,448,231 A * 6/1969 Heft ..... H01H 9/342 218/149
3,617,667 A * 11/1971 Kirschner ..... H01H 33/58 218/81
(Continued)

FOREIGN PATENT DOCUMENTS

EP 0 437 151 A1 7/1991
EP 0 437 151 B1 4/1995
(Continued)

OTHER PUBLICATIONS

French Preliminary Search Report dated Jul. 5, 2016 in French application 15 62144, filed on Dec. 10, 2015 ( with English Translation of Categories of Cited Documents).
(Continued)

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

A high-voltage multipolar circuit breaker including a first chamber for receiving gases, in communication with a first arc quenching chamber, and including a first aperture for exhausting gases to the exterior of the casing, the aperture being provided with a first downstream filtering device. The circuit breaker furthermore includes at least one second chamber for receiving gases, in communication with at least one second arc quenching chamber of another pole of the circuit breaker, the chamber itself being equipped with a second upstream device for filtering gases, the second chamber for receiving gases including a second aperture for exhausting gases to the exterior of the casing, the chamber being provided with a second downstream filtering device, the first chamber for receiving gases and the second chamber
(Continued)

for receiving gases being separated fluidically one from the other by an impermeable wall.

8 Claims, 5 Drawing Sheets

(51) Int. Cl.
*H01H 73/18* (2006.01)
*H01H 33/65* (2009.01)

(58) Field of Classification Search
USPC ..... 218/157, 155, 156, 149; 335/201
See application file for complete search history.

(56) References Cited

U.S. PATENT DOCUMENTS 5,889,249 A 3/1999 Rival et al.
6,218,636 B1 4/2001 Blancfene et al.
6,248,971 B1 * 6/2001 Morel ..... H01H 9/40 218/157
6,960,736 B1 11/2005 Bach et al.
6,977,354 B1 * 12/2005 Shea ..... H01H 9/342 218/157
7,488,915 B2 * 2/2009 Pollitt ..... H01H 9/342 218/149
7,598,833 B1 * 10/2009 Hodges ..... H01H 9/342 335/201
2010/0170876 A1 * 7/2010 Bach ..... H01H 9/342 218/157
2012/0211469 A1 * 8/2012 An ..... H01H 9/346 218/149
2015/0136740 A1 * 5/2015 Afshari ..... H01H 33/08 218/149

FOREIGN PATENT DOCUMENTS

EP 0 817 223 A1 1/1998
FR 2 788 372 A1 7/2000

OTHER PUBLICATIONS

Preliminary Search Report dated Jul. 5, 2016 in French Patent Application No. FR 1562144 (with English translation of Categories of Cited Documents, previously filed on Oct. 18, 2016).

* cited by examiner

MULTIPOLAR AIR-BREAK CIRCUIT BREAKER INCLUDING AN IMPROVED DEVICE FOR FILTERING QUENCHING GAS

The present invention relates to a multipolar air-break circuit breaker for high currents.

In the known way, electrical circuit breakers allow electrical systems to be protected against abnormal conditions such as overvoltages, short circuits or overcurrents. Typically, these circuit breakers include, for each electrical pole of these circuit breakers, electrical contacts, the contact pads of which are connected to input and output terminals, and which can be moved in order to interrupt the flow of electrical current when an abnormal situation is detected. Air-break circuit breakers are notably known, and in such circuit breakers these electrical contacts are placed in an air-filled arc quenching chamber. When these contacts are closed, the electrical current can circulate through these conductors. When one of these contacts is open for one of the poles of the circuit breaker, for example in response to an operational anomaly such as an overvoltage or a short circuit, the contact pads of these contacts are distant from one another. An electric arc forms between these two contact pads. This electric arc ionizes the air present in the arc quenching chamber as this generates gases, referred to as quenching gases, which are then expelled to the outside of the circuit breaker. The electric arc is then extinguished by the arc quenching chamber, making it possible to interrupt the flow of electrical current for this pole. These quenching gases are at high temperature, generally above 2000° C., and are also partially ionized. They may furthermore contain particles in suspension, such as soot and/or metallic particles. These particles in suspension typically originate from a partial melting of the internal components of the circuit breaker in contact with the electric arc. These quenching gases may therefore present a danger and need to be cooled and de-ionized before they can be expelled to the outside of the circuit breaker.

Patent application EP 0 437151 A1 describes such a circuit breaker provided with a device for cooling the quenching gases before they are expelled to the outside. This circuit breaker comprises two devices for filtering the expelled quenching gases, which devices are separated from one another by a single gas receiving chamber common to the entire circuit breaker. The expelled quenching gases circulate in this common receiving chamber before being exhausted towards the outside of the circuit breaker.

One disadvantage with this circuit breaker is that it does not allow effective cutting-off of the electric current when used in electrical circuits that involve higher DC electric voltages, typically of between 1000 V and 1500 V. Specifically, in such cases, the quenching gases expelled from the circuit breaker are not sufficiently cooled or de-ionized, encouraging the formation of a short-circuiting electric arc between the poles of the circuit breaker, at the circuit breaker electrical connection terminals situated on the outside of this circuit breaker. This leads to an unacceptable lack of safety.

It is these disadvantages that the invention more particularly seeks to overcome by proposing a multipolar electric air-break circuit breaker which has enhanced effectiveness and safety, while at the same time maintaining a simple design and being of moderate cost.

To this end, the invention relates to a high-voltage multipolar circuit breaker, comprising a plurality of poles and a casing into which are placed, in separate compartments, for each pole of the circuit breaker:

an input terminal and an output terminal, two electrical contact pads, which are respectively connected to the input and output terminals of this pole and are movable between:

a closed position in which they are in direct contact with one another, and an open position in which they are separated from one another, a first arc quenching chamber in which said two electrical contact pads are placed and one wall of which includes a first gas discharge opening provided with a first upstream device for filtering gases, the circuit breaker including a first chamber for receiving gases in communication with the first arc quenching chamber via the first discharge opening and comprising a first aperture for exhausting gases to the exterior of the casing, which aperture is provided with a first downstream filtering device, characterized in that:

the circuit breaker furthermore includes at least one second chamber, for receiving gases, in communication with at least one second arc quenching chamber of another pole of the circuit breaker, via a second gas discharge opening of this second arc quenching chamber, which is itself equipped with a second upstream device for filtering gases, in that the second chamber for receiving gases includes a second aperture for exhausting gases to the exterior of the casing, which aperture is provided with a second downstream filtering device, and in that the first chamber for receiving gases and the second chamber for receiving gases are separated fluidically from one another by an impermeable wall.

By virtue of the invention, the effectiveness of the breaking function of the circuit breaker, and therefore the safety, are improved, and this is achieved without significantly increasing the complexity of the circuit breaker.

Specifically, by providing several gas receiving chambers separated fluidically from one another by impermeable walls, rather than a single gas receiving chamber that is in fluidic communication with all the arc quenching chambers of the circuit breaker, it is possible to prevent any undesired looping-back of the current between various poles from being able to occur. Such looping-back may occur in the prior art through the formation of an electric arc between a contactor of an arc quenching chamber of one of the poles of the circuit breaker and another electric contactor of another arc quenching chamber of another pole of the circuit breaker of opposite polarity. The operating safety of the circuit breaker according to the invention is thus improved.

In addition, it is possible to use such a circuit breaker with DC voltages under good safety conditions since, on account of the impervious separation between the gas receiving chambers, the uncooled quenching gases from one of the poles cannot mix with the uncooled quenching gases from other poles of the circuit breaker, these other poles having different polarities.

The circuit breaker according to the prior art works only with AC voltages because, owing to the phase shift between the poles, the circuit-breaking energies at a given moment differ from one pole to another. The risk of the current looping back between two of these poles is therefore low.

Another advantage of the invention is that the cooling and de-ionization of the quenching gases are improved. The various gas receiving chambers each have a smaller volume than a gas receiving chamber common to the entire circuit breaker. Surprisingly, the geometry of the gas receiving chambers facilitates the triggering, through self-ignition, of a combustion of the quenching gases within this receiving chamber. This combustion notably makes it possible to reduce the quantity of particles in suspension in the quenching gas exhausted from the gas receiving chamber. That makes it possible to greatly reduce the risk of short circuiting by the looping-back of an electrical current outside the circuit breaker when these quenching gases are expelled therefrom. Thus, the cleaning of the gases is improved without the need to use filtering devices with superior dimensions or filtration properties, something that would make manufacture of the circuit breaker more complicated and push up the cost thereof.

According to advantageous but non-compulsory aspects of the invention, such a circuit breaker may incorporate one or more of the following features considered in any technically permissible combination:

- The circuit breaker includes a gas receiving chamber for each pole, these gas receiving chambers being distinct from one another and separated fluidically by impermeable walls, each of these receiving chambers being connected fluidically to only the arc quenching chamber of the corresponding pole and via said corresponding gas discharge opening, and comprising an aperture for exhausting gases to the exterior of the casing, which aperture is provided with a downstream gas filtering device, this gas exhausting aperture being distinct from the gas exhausting apertures of the other gas receiving chambers of the circuit breaker.
- The downstream gas filtering device of each of said gas receiving chambers is distinct from the respective downstream gas filtering device of the other gas receiving chambers of the circuit breaker.
- Each gas receiving chamber is connected fluidically to at most two arc quenching chambers via their respective gas discharge openings.
- The respective poles corresponding to two arc quenching chambers connected fluidically to one and the same common gas receiving chamber are electrically connected up in series with one another.
- The downstream gas filtering device of each of said gas receiving chambers extends in a plane orthogonal to the plane in which the upstream gas filtering device of the arc quenching chamber with which it is in fluidic communication extends.
- The downstream gas filtering device includes a stack of a plurality of layers of rep fabric with different mesh aperture size, these layers of rep fabric being arranged in the stack in such a way as to exhibit decreasing mesh aperture sizes, the layers positioned on the gas receiving chamber side having a mesh aperture size that is greater than the mesh aperture size of the layers of fabric in the stack that are positioned towards the outside of the circuit breaker.
- The layers of the stack of the downstream filtering device have a mesh aperture size of between 100 μm and 500 μm, the mesh aperture size being defined as being the hydraulic diameter of a mesh aperture of the fabric of this layer.
- Each gas receiving chamber includes a cover attached to the air quenching chamber or chambers with which this receiving chamber is in fluidic communication, covering the corresponding gas discharge opening or openings, this cover being held firmly in place on the casing with no degree of freedom by fixing elements.
- The circuit breaker includes, for each gas receiving chamber, a sealing element placed between the cover and the casing.

The sealing element is a flat gasket compressed between the cover and the casing.

The invention will be better understood and other advantages thereof will become more clearly apparent from the description which will follow of one embodiment of a high-voltage multipolar circuit breaker, which is given solely by way of example and by reference to the attached drawings in which:

FIGS. 1 to 3 depict a high-current air-break multipolar circuit breaker 2. What is meant by multipolar is that the circuit breaker 2 is intended to be used in an electrical circuit comprising a plurality of electrical poles.

Figure 4:
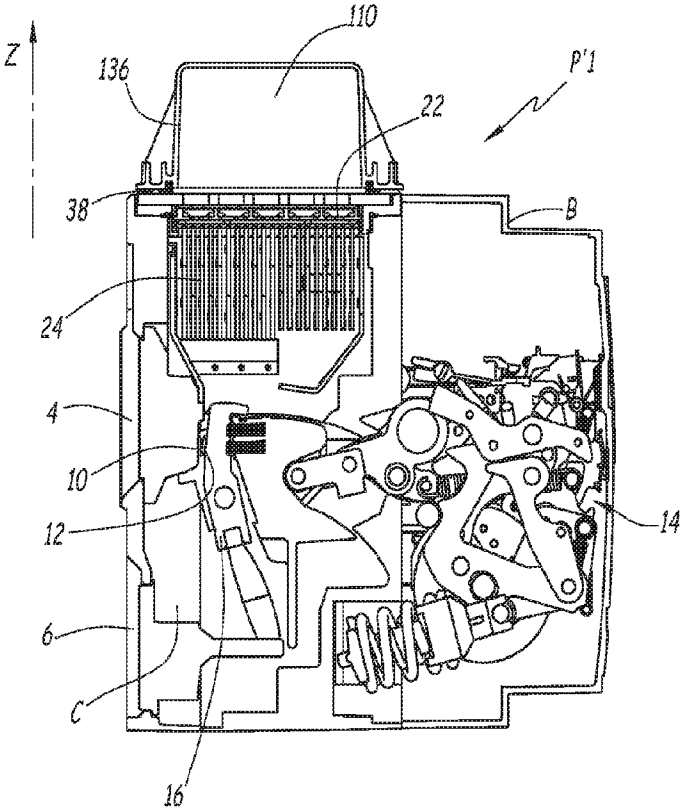
FIG. 4 is a schematic depiction in transverse section of another embodiment of the circuit breaker of FIG. 1.
Figure 1:
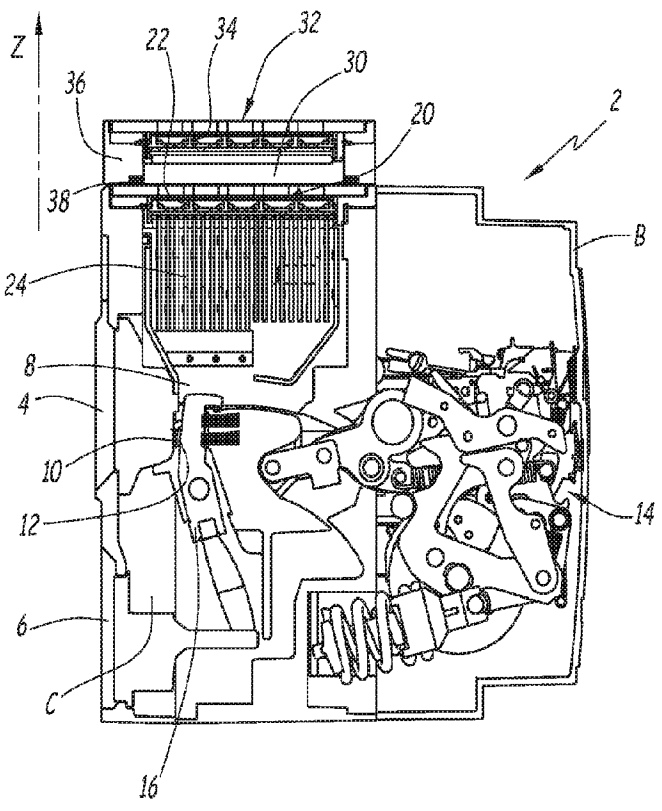
FIG. 1 is a schematic depiction in cross section of a high-voltage multipolar circuit breaker.
Figure 2:
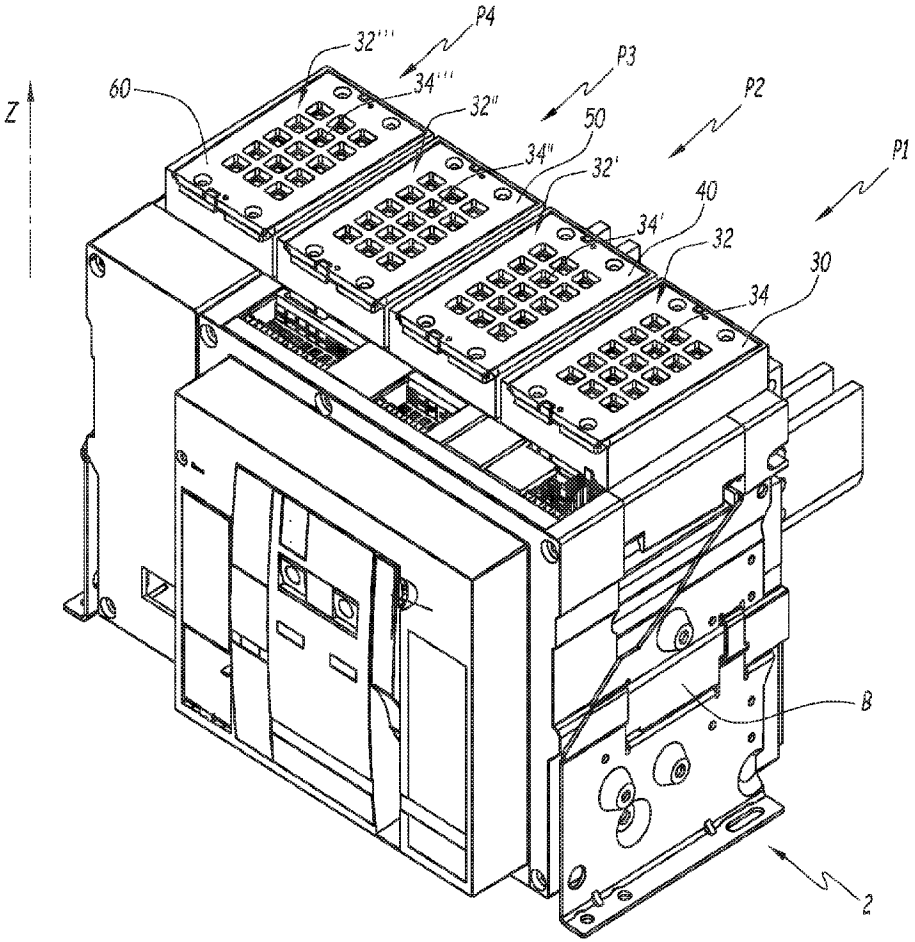
FIG. 2 is a perspective view of the circuit breaker of FIG. 1.

In this example, the circuit breaker 2 comprises four poles P1, P2, P3, P4 which are independent. For example, the circuit breaker is intended to be used to protect a DC circuit comprising three poles. Here, the poles P1 and P2 are connected in series to a first polarity of the electrical circuit that is to be protected. The poles P3 and P4 are connected up in series to a second polarity of this circuit. However, other configurations are possible. In this instance, a permanent direct current of 4000 A can flow across each pole P1, P2, P3 and P4 with a potential difference of 1500 V between terminals of this pole.

As an alternative, the circuit breaker 2 may include a different number of poles, for example two or three. The circuit breaker 2 may also be used in an AC circuit.

The circuit breaker 2 includes a closed casing B divided into a plurality of separate compartments C. The casing B is for example made of moulded plastic. Each compartment C extends substantially along a longitudinal axis Z of the circuit breaker 2. This axis Z in this instance is vertical. In this instance the compartments C are identical.

The casing in this instance includes as many compartments C as there are poles. Each pole P1, P2, P3 and P4 is associated with one compartment C. The circuit breaker 2 furthermore includes, for each pole P1, P2, P3 and P4, housed inside the compartment C associated with this pole, the following elements: electrical input 4 and output 6 terminals, an arc quenching chamber 8, an electrical contact comprising two electrical contact pads 10 and 12 which can be moved, and a mechanism 14 for moving the pads 10 and 12. In this example, these elements are identical from one pole to the other. They will therefore be described in detail only in respect of the pole P1 of the circuit breaker 2.

The terminals 4 and 6 are configured for electrically connecting up the circuit breaker 2 to an electrical circuit that is to be protected. For example, the circuit breaker 2 is connected up to connection terminals of the circuit in an electrical enclosure. The terminals 4 and 6 are made of an electrically conducting material, generally a metal such as copper. The terminals 4 and 6 are accessible from outside the casing B.

The pads 10 and 12 are electrically connected up to the terminals 4 and 6 respectively by conductors which have not been illustrated. For example, the pads 10 and 12 comprise lands made of a metallic material, such as silver or copper. These pads 10 and 12 are movable, selectively and reversibly, between a closed position and an open position. In the closed position, the pads 10 and 12 are in direct contact with one another and allow an electrical current to circulate between the terminals 4 and 6. In their open position, the pads 10 and 12 are distant from one another. For example, in this open position, the pads 10 and 12 are distant from one another by at least one centimeter and, for preference, by at least two centimeters.

In this example, the pad 10 is fixed securely to a fixed wall of the compartment C of the pole P1. The pad 12 is fixed to a mobile leg 16 configured to be set in motion by the mechanism 14.

The mechanism 14 is configured to open the contact, which means to say to move the pads 10 and 12 from the closed position into the open position when an operational anomaly is detected. This detection is, for example, performed by an electronic trip circuit, not illustrated. This mechanism 14 is advantageously configured so that when it opens the contact pads 10 and 12 this leads to the opening of the contactors of the other poles P2, P3 and P4 of the circuit breaker 2, for example via respective mechanisms 14 belonging to the poles P2, P3 and P4.

An operational anomaly is, for example, an overload, a short circuit or an excessively high intensity of the electrical current circulating through the circuit that is to be protected, in the case of at least one of the poles P1, P2, P3 or P4.

The arc quenching chamber 8 is formed inside the compartment C associated with the pole P1 in an upper part of the compartment C. This chamber 8 includes a first gas discharge opening 20, in this instance formed in an upper end wall of this chamber 8. This discharge opening 20 is of rectangular shape and has a surface area at least equal to 30% or to 50% of the surface area of the upper face of this end wall. The quenching gases emanating from the chamber 8 cannot leave the chamber 8 by any means other than via the discharge opening 20. This discharge opening 20 is provided with an upstream gas filtering device 22, which will be described in greater detail in what follows. The terms "upstream" and "downstream" are defined here in relation to the direction in which the quenching gases flow, from the chamber 8 towards the exterior of the circuit breaker 2.

In the known way, the chamber 8 comprises a plurality of arc extinguishing plates 24 intended to extinguish an electric arc that forms in the chamber 8 when the pads 10 and 12 open while a current is circulating across these pads 10 and 12. These plates 24 in this instance are sheet metal plates extending parallel to one another and parallel to the axis Z between the opening 20 and the pads 10 and 12. These plates 24 allow the quenching gases to pass towards the discharge opening 20. Such an arc quenching chamber 8 is described for example in patent application FR 2 788 372 A1.

The device 22 is configured to cool and de-ionize, at least in part, the quenching gases that are discharged from the chamber 8 after an electric arc has formed following the opening of the circuit breaker 2. This de-ionization is performed on the one hand by cooling the quenching gas and, on the other hand, by trapping particles in suspension in the quenching gas. These particles in suspension are typically metallic particles or soot, notably carbonized, resulting from a partial melting of various components of the circuit breaker 2 which are situated inside the chamber 8 when an electric arc forms at the moment of opening of the circuit breaker. The device 22 is configured in this instance to cool the quenching gases exiting the chamber 8 down to a temperature of less than or equal to 2500° C., preferably 2000° C. Typically, the quenching gases when leaving the chamber 8 and before entering the device 22 have a temperature greater than or equal to 4000° C. or 6000° C. and less than 10 000° C.

In this description, the temperature of the quenching gases in the chamber 8 is measured in a region of this quenching gas that is distant from the electric arc, when this electric arc is present. Specifically, the temperature is locally very high, generally higher than 10 000° C., in the immediate vicinity of the electric arc, and cannot always be measured.

A person skilled in the art knows how to measure the temperature of the quenching gas. For example, for temperatures greater than 2000° C., quenching gas temperature measurements are performed using conductimetry: the electrical conductivity of the gas is measured, then the corresponding temperature of the gas is deduced from a predefined curve giving the change in conductivity of this gas as a function of temperature. Such curves are, for example, available in scientific literature. For example, use is made here of the curve for pure air. For temperatures of below 2000° C., a rapid-response thermocouple can be used, for example the type K thermocouple from the Thermocoax company.

For example, the device 22 includes a porous screen to prevent the quenching gas from being exhausted directly on a rectilinear path towards the exterior of the circuit breaker but which rather alters the flow of the gas in order to lengthen its path. This encourages exchanges of heat with the device 22 and leads to a reduction in the temperature of this gas. This porous screen in this instance comprises a stack of layers of metallic fabric, referred to as rep fabric. Such a porous screen is described in patent application EP 0 817 223. In this example, these rep fabrics are made from stainless steel. The layers of rep fabric of the device 22 have a progressive mesh aperture size that decreases from the chamber 8 towards the chamber 30. The layers of rep fabric in this instance are planar in shape and extend in a geometric plane that is horizontal and perpendicular to the axis Z.

In this application, the mesh aperture size of a rep fabric is defined as being equal to the hydraulic diameter of a nominal mesh aperture of the fabric. The mesh cells of a layer of rep fabric in this instance all have the same mesh aperture size.

This progressive opening-up is achieved by arranging the stack of layers of rep fabric in such a way that the layer of fabric that has the highest mesh aperture size is situated at the inlet of the device 22, namely on the side of the chamber 8, and the one that has the lowest mesh aperture size is situated at the outlet of the device 22, namely on the side of the chamber 30. The intermediate layers of fabric situated between this inlet and this outlet have decreasing mesh aperture sizes, in this instance the decrease being a linear decrease.

For example, the mesh aperture size of the layers of rep fabric of the device 1 is greater than or equal to 50 μm or greater than or equal to 100 μm or greater than or equal to 200 μm. For preference, the mesh aperture size is less than 1 mm or than 2 mm.

The device 22 includes several porous screens which are independent of one another and juxtaposed side by side with one another in one and the same plane, in this instance a horizontal plane, in the region of the discharge opening 20. These porous screens are separated from one another by an impervious material which prevents the quenching gases from passing between these porous screens. This configuration forces the quenching gas to circulate in parallel through these various porous screens as it passes through the device 22.

These porous screens occupy at least 50%, preferably at least 60%, or 80% or 90% of the surface area of the opening 20. In this instance, the device 22 includes five identical porous screens.

By using independent porous screens from which to form the device 22 it is possible to avoid short circuits from occurring through a looping-back of the current when the quenching gas is circulating through the device 22.

As an alternative, it is possible to use just one porous screen extending over at least 80% or 90% of the surface area of the discharge opening 20. This porous screen is then said to be "monoblock".

The circuit breaker 2 furthermore includes a gas receiving chamber 30. This chamber 30 is in fluidic communication with the chamber 8 through the opening 20. The chamber 30 includes a gas exhausting aperture 32 which opens towards the outside of the circuit breaker 2. This aperture 32 is provided with a downstream filtering device 34.

The chamber 30 is configured to cool and de-ionize the quenching gases before they are expelled from the circuit breaker 2. The quenching gas is considered to have been cooled enough to be expelled if its temperature is less than or equal to 1500° C. or less than or equal to 800° C. Below these temperatures, the gas no longer has enough electrical conductivity to allow a short circuit to occur even, for example on an electrical distribution board to which the circuit breaker 2 is connected, in the presence of high electrical voltages greater than or equal to 5000 V.

In this example, the device 34 includes a porous screen formed of a stack of layers of rep fabric which covers at least 60%, preferably 80% or 90%, of the surface area of the aperture 32. The device 34 in this instance is identical to the device 22. Just like the device 22, the mesh aperture size of the layers of rep fabric decreases from the inlet of the device 34, which means to say from the side of the chamber 30, towards the outlet of the device 34, which means to say the side which opens to the outside of the circuit breaker 2.

The device 34 here extends parallel to the device 22. The devices 22 and 34 are spaced apart from one another by a distance greater than or equal to 2 cm.

In practice, it is particularly advantageous to use identical porous screens for the devices 22 and 34, for industrialization reasons. However, as an alternative, the devices 34 and 22 could be different.

The chamber 30 here has a volume of between 200 $cm^3$ and 1000 $cm^3$ and preferably between 250 $cm^3$ and 800 $cm^3$. For example, the volume of the chamber 30 is between 0.1 and 0.5 times the volume of the compartment C.

The chamber 30 includes a cover 36 which delimits walls of this chamber 30. This cover 36 in this instance is attached to an upper face of the casing B, in the region of the chamber 8 with which this chamber 30 is in communication. The cover 36 thus covers the entire opening 20. This cover 36 is held firmly on the casing B, with no degrees of freedom, by fixing elements such as screws. A sealing element 38 is placed between the cover 36 and the casing B, in order to seal the chamber 30 and prevent the quenching gas from being able to leave the chamber 30 by any way other than via the aperture 32. This sealing element 38 in this instance is a flat gasket, for example made of silicone, compressed between the cover 36 and the casing B when the cover 36 is assembled with the casing B. The chamber 30 is notably configured to withstand a pressure greater than or equal to ten bar or fifteen bar, preferably twenty bar. For example, the cover 36 is made of glass fibre reinforced plastic such as the material known by the name of "polyester glass mat". The fixing elements are, for example, high-strength screws and have a shear strength greater than or equal to 50 $daN/mm^2$, preferably 120 $daN/mm^2$. That allows the cover 36 to be kept pressed firmly against the casing B despite the significant and rapid variation in pressure when the quenching gas leaves the chamber 8 to enter the chamber 30.

The circuit breaker 2 furthermore includes gas receiving chambers 40, 50 and 60 for the poles P2, P3 and P4 respectively. These chambers 40 and 50 are identical to the chamber 30, and differ therefrom only in terms of the following features:

- the chamber 40 is in fluidic connection only with the gas quenching chamber associated with the pole P2;
- the chamber 50 is in fluidic connection only with the gas quenching chamber associated with the pole P3;
- the chamber 60 is in fluidic connection only with the gas quenching chamber associated with the pole P4.

The references 32' and 34' respectively denote the quenching gas exhaust aperture of the chamber 40 and the downstream filtering device borne by the aperture 32'. Likewise, the references 32" and 34" respectively denote the quenching gas exhaust aperture of the chamber 50 and the downstream filtering device borne by the aperture 32". The references 32'" and 34'" respectively denote the quenching gas exhaust aperture of the chamber 60 and the downstream filtering device borne by the aperture 32". The apertures 32', 32" and 32'" are in this instance identical to the aperture 32. The devices 34', 34" and 34'" are in this instance identical to the device 34. The covers 36', 36" and 36'" are in this instance identical to the cover 36.

More specifically, each chamber 30, 40, 50, 60 is in fluidic communication only with a single arc quenching chamber associated with just one of the poles, P1, P2, P3 and P4 respectively. Each chamber 30, 40, 50 and 60 is therefore not in fluidic communication with the arc quenching chamber of another pole, which means that the quenching gases emanating from the arc quenching chamber of another pole cannot enter this gas receiving chamber. The chambers 30, 40, 50 and 60 are separated fluidically from one another, in this instance by the impervious walls of the respective covers 36, 36', 36" and 36'" which delimit these gas receiving chambers. Each device 34, 34', 34" and 34'" is distinct from the respective downstream gas filtering device of the other gas receiving chambers of the circuit breaker 2.

By forming independent gas receiving chambers 30, 40, 50 and 60 for each of the poles P1, P2, P3 and P4 rather than a single receiving chamber common to all the poles P1, P2, P3 and P4, the risk of a short circuit forming between the pads 10 or 12 of different poles P1, P2, P3 or P4 of the circuit breaker via the quenching gas present in this common gas receiving chamber is reduced. Specifically, for as long as the quenching gas is not sufficiently cooled, it has a high electrical conductivity making it possible for such short circuits to appear. This is all the more true when the electrical voltages involved are high. Thus, the operational safety and effectiveness of the circuit breaker 2 are improved.

Furthermore, each of the chambers 30, 40, 50 or 60 allows for better cooling of the quenching gases by making it possible for this quenching gas to be combusted within it. Specifically, the inventors have demonstrated that such combustion occurs spontaneously by self-ignition of the quenching gas in the chamber 30 once the electric arc present in the chamber 8 has been quenched. What is meant by self-ignition is a phenomenon of combustion that is initiated spontaneously, without the input of additional energy.

In this example, self-ignition of the quenching gas occurs inside the chamber 30 when the pressure generated by the quenching gas inside this chamber 30 begins to drop, after the electric arc in the quenching chamber 8 has been quenched. This drop in pressure causes ambient air, containing oxygen, to enter the chamber 30 via the aperture 32, the quenching gas being at a temperature greater than 2000° C. initially having a pressure greater than 1.5 bar and including electrically charged particles in suspension in the gas at a concentration greater than or equal to 50 parts per million (ppm) or greater than or equal to 100 or to 1000 ppm. Because of this combustion, these particles in suspension in the quenching gas are to a great extent destroyed and are therefore no longer present in the quenching gas when it is expelled out of the circuit breaker 2, thereby reducing its electrical conductivity.

One example of the operation of the circuit breaker 2 will now be described. For the sake of simplicity, this description will be given only with reference to the pole P1.

The pads 10 and 12 are initially in their closed position and an electrical current circulates normally between the terminals 4 and 6. The pads 10 and 12 are then opened, for example following detection of an operational anomaly. To achieve that, the mechanism 14 automatically moves the leg 16 in order to move the pad 12 away from the pad 10. An electric arc is formed as a result between the pads 10 and 12. Because of this electric arc, the air initially present in the chamber 8 is ionized and heated up to a temperature greater than or equal to 4000° C. or greater than or equal to 6000° C.

This ionized gas corresponds to the quenching gas. This quenching gas, because of its high temperature and high pressure, is exhausted from the chamber 8 by passing through the opening 20 and therefore by passing through the device 22. For example, inside the chamber 8, before passing through the device 22, the quenching gas has a temperature greater than 6000° C. and a conductivity greater than or equal to 50 siemens/m (s/m).

In the known way, this electric arc is then quenched in the chamber 8, for example after a length of time less than or equal to 10 ms or less than or equal to 100 ms after it has appeared.

Because of the configuration of the device 22, the quenching gas follows a path that is far longer than if the device 22 were not present. The exchanges of heat between the quenching gas and the material of which rep fabrics of the porous screen of the device 22 are formed allow this quenching gas to be cooled, at least in part, as it enters the chamber 30. For example, the temperature of the quenching gas is then no higher than 2000° C. in the chamber 30. In addition, the device 22 traps some of the particles in suspension in the quenching gas, thereby contributing to reducing the electrical conductivity thereof.

A stream of quenching gas enters the chamber 30 via the opening 20 and therefore through the device 22. This quenching gas here has a temperature at most equal to 2000° C., a pressure greater than or equal to 1.5 bar and includes electrically charged particles in suspension at a concentration greater than or equal to 50 parts per million (ppm) or greater than or equal to 100 ppm or greater than or equal to 1000 ppm. When the electric arc is quenched in the chamber 8, the pressure of the quenching gas drops, and this allows ambient air to enter the chamber 30 from outside the circuit breaker 2. This ambient air enters the chamber 30 through the aperture 32. For example, the pressure of the quenching gas drops down to a value less than or equal to the atmospheric pressure of the ambient air in the vicinity of the circuit breaker 2. This ambient air contains oxygen, which acts as an oxidant and triggers the phenomenon of combustion inside the chamber 30.

The quenching gas then, within the chamber 30, undergoes self-ignition which triggers a combustion of this gas. This combustion has a duration lasting less than 200 ms. This combustion notably allows the quenching gas to be rid of the particles with which it is laden by burning them, this contributing to its de-ionization. The conditions required for self-ignition are notably dependent on the temperature of the quenching gas, on the pressure of this quenching gas, and on the injection of ambient air containing oxygen, from outside the circuit breaker after the electric arc has been extinguished in the chamber 8. In this example, the inventors have determined that a temperature greater than 1000° C. and a pressure greater than 1.5 bar or than 2 bar is needed in order to trigger self-ignition with injection of oxygen. These pressure and temperature parameters are not, in practice, generally parameters that can be monitored directly by a user of the circuit breaker 2 but are directly dependent on the value of the voltage across the terminals of the pads at the circuit-breaking moment. Given the dimensions of the chamber 30 and because the quenching gas is ionized air, the self-ignition phenomenon occurs when the electrical voltage across the terminals 4 and 6 is greater than or equal to 1500 V or greater than or equal to 1800 V or greater than or equal to 2000 V. Finally, this gas leaves the chamber 30 through the opening 32, passing through the device 34. At this stage, when it leaves the chamber 30, the gas is at a temperature less than 1500° C. and has a concentration in conducting particles that is low enough to obviate any risk of a short circuit through the looping-back of current outside the circuit breaker. For example, the electrical conductivity of the quenching gas is less than or equal to $10^{-10}$ S/m or less than or equal to $10^{-15}$ S/m.

Figure 3:
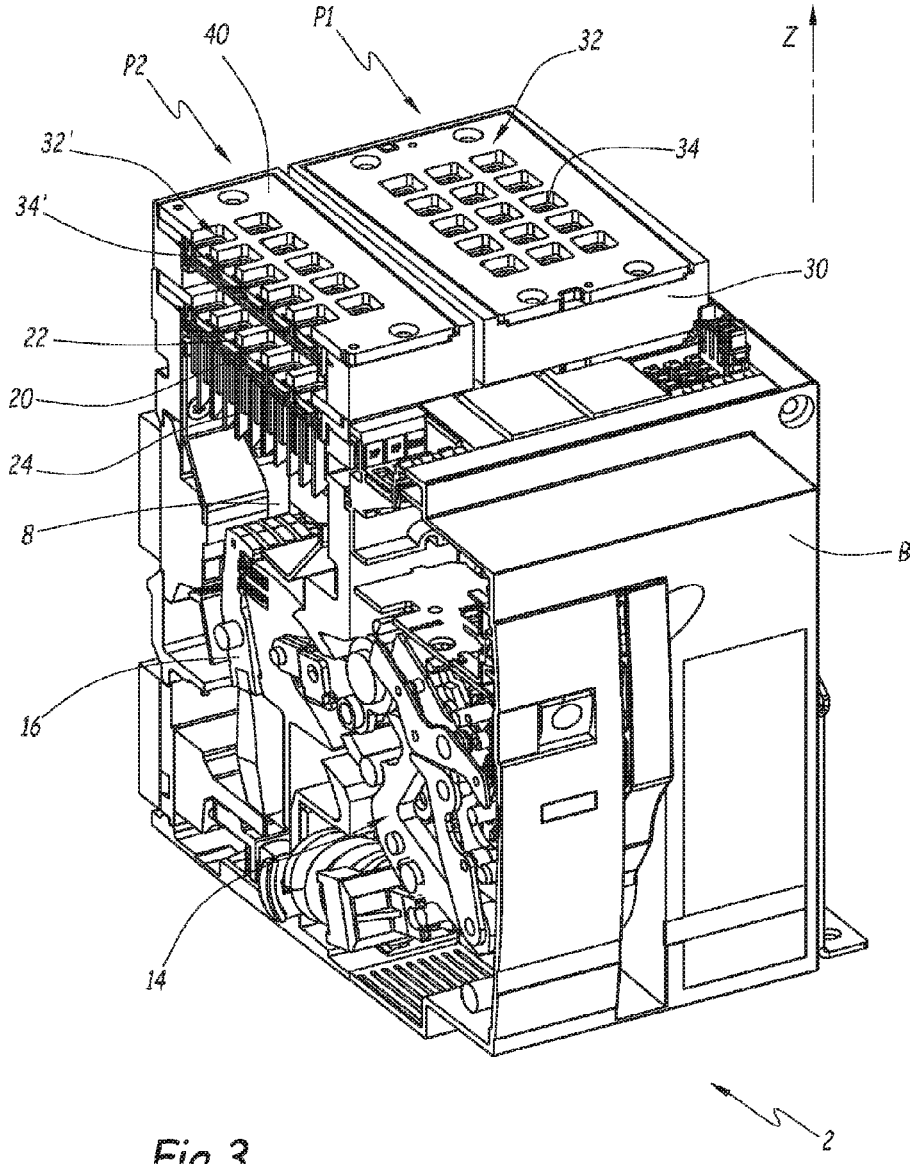
FIG. 3 is a cutaway view of the circuit breaker of FIGS. 1 and 2.
Figure 5:
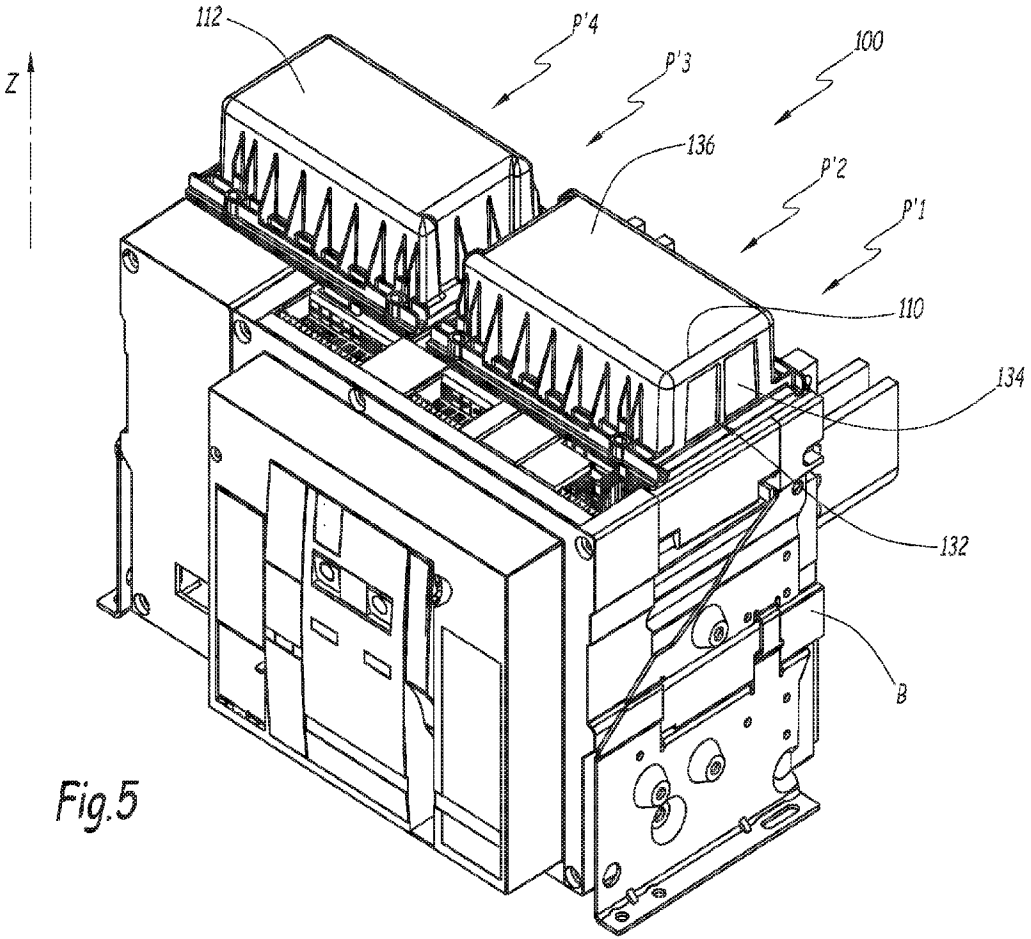
FIG. 5 is a perspective view of the circuit breaker of FIG. 3.
Figure 6:
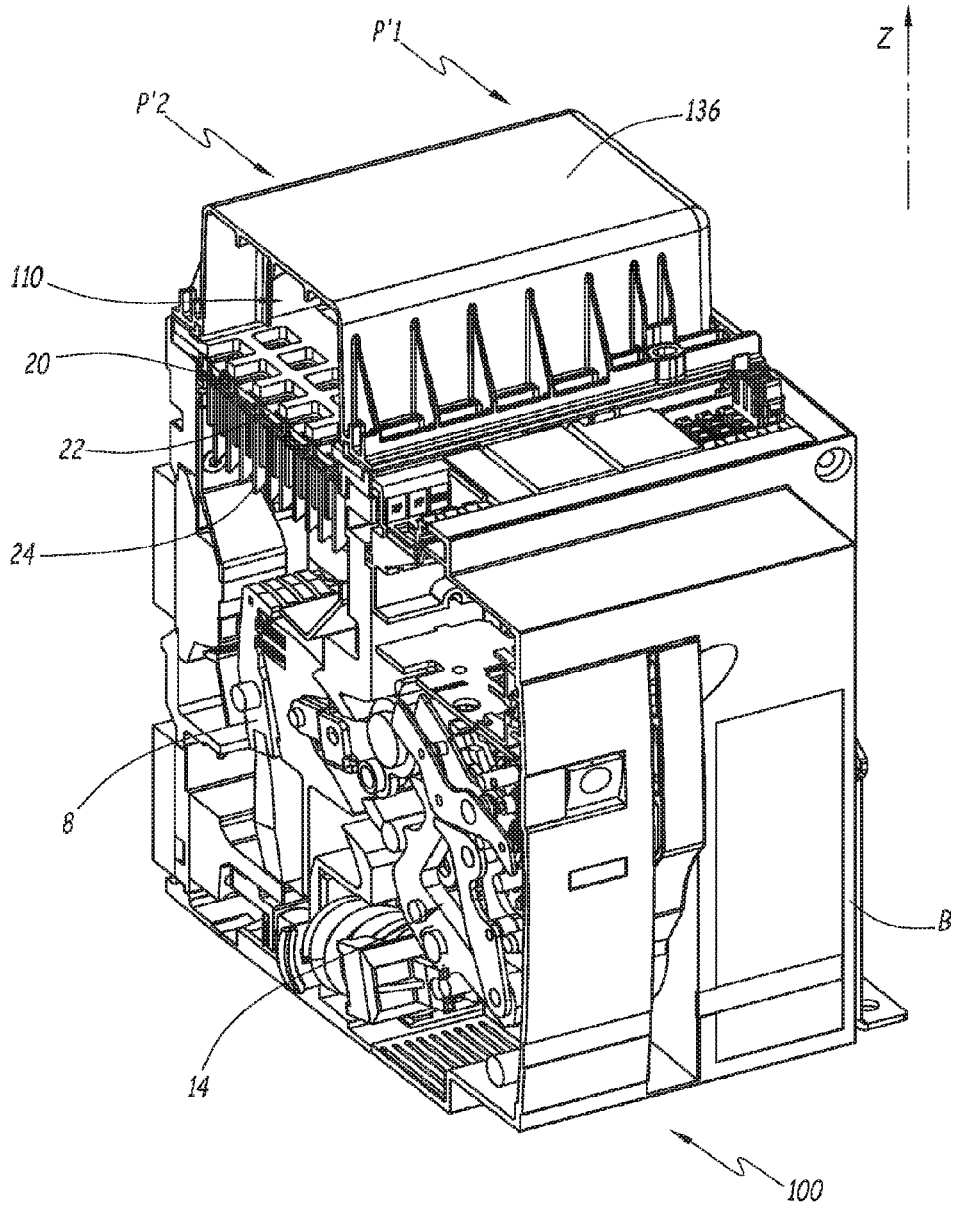
FIG. 6 is a cutaway view of the circuit breaker of FIGS. 4 and 5.

FIGS. 4 to 6 depict another embodiment of the circuit breaker 2. More specifically, FIG. 3 depicts a multipolar circuit breaker 100 comprising four poles P'1, P'2, P'3 and P'4.

This circuit breaker 100 is identical to the circuit breaker 2, but differs therefrom in terms of the number of poles and by the fact that the chambers 30, 40, 50 and 60 are replaced by two chambers 110 and 112. The chamber 110 is common to the poles P'1 and P'2, which means to say that the gas discharge openings of the respective quenching chambers of the poles P'1 and P'2 both open into this chamber 110. The same is true of the chamber 112 with respect to the quenching chambers of the poles P'3 and P'4. The chambers 110 and 112 are identical and so only the chamber 110 is described in detail in what follows.

The chamber 110 includes a gas discharge aperture 132 provided with a downstream filtering device 134. The aperture 132 and the device 134 perform the same respective roles as the aperture 32 and the device 34.

For example, the device 134 comprises a monoblock porous screen analogous to the monoblock screen described with reference to the device 34. Here, the device 134 extends in a plane orthogonal to the plane in which the device 22 extends. That allows the quenching gases to be diverted outside the circuit breaker 100 towards a peripheral region of the circuit breaker 100, preferably away from the connection terminals of the circuit breaker, in order to avoid any short circuit through the looping-back of the current through the expelled quenching gas.

In this instance, the chamber 110 is delimited by a cover 136, analogous to the cover 36 of the circuit breaker 2, which in this instance covers the entire surface of the discharge openings of the arc quenching chambers associated with the poles P'1 and P'2.

The chamber 110 here has a volume of between 1000 $cm^3$ and 3000 $cm^3$. For example, the chamber 110 has a volume of between 0.1 time and 0.5 times the sum of the respective volumes of the compartments C respectively associated with the poles P'1, P'2 for which the chamber 110 is a chamber in common.

This embodiment is particularly advantageous in the case of circuit breakers exhibiting less demanding performance. This embodiment has the advantage of reducing the number of downstream filtering devices required but has the disadvantage that the pressure that the chamber 110 or 112 is able to withstand is lower, for example less than or equal to 3 bar or less than or equal to 5 bar. In addition, the poles P'1 and P'2 need to have the same polarity in order to avoid a short circuit through the looping-back of the current in the chamber 110. The same is true of the poles P'3 and P'4. The poles P'1 and P'2 in this instance are connected in series with one another and correspond to one and the same polarity or to one and the same phase.

There are numerous other possible embodiments. For example, the circuit breaker may include a different number of poles. The poles may be configured differently.

The chamber 112 may be replaced by two independent gas receiving chambers, for example analogous with the chambers 30 and 40, in order to isolate the quenching gas leaving the corresponding poles. The poles P'1 and P'2 here are connected up in series with one another and correspond to one and the same polarity or to one and the same phase.

The device 34 may include a different number of porous screens, for example between one and twenty, preferably between five and ten.

The temperature, pressure and/or electrical conductivity values may be different, particularly since these are dependent on the operating conditions such as the magnitude of the current and/or of the voltage across the pads 10 and 12 at the moment at which the electric arc is formed.

The circuit breakers 2 and 100 may be used with alternating current, for example with three-phase alternating current.

The alternative forms considered hereinabove may be combined with one another to generate new embodiments of the invention.

The invention claimed is:

1. A multipolar circuit breaker comprising:

a plurality of poles; and a casing into which are placed, in separate compartments and for each pole of the circuit breaker:

an input terminal and an output terminal, two electrical contact pads respectively connected to the input and output terminals of a corresponding pole and are movable between:

a closed position in which the two electrical contact pads are in direct contact with one another, and an open position in which the two electrical contact pads are separated from one another, a first arc quenching chamber in which said two electrical contact pads are placed, the first arc quenching chamber including one wall with a first gas discharge opening formed thereon and provided with a first upstream device to filter gases, the circuit breaker including a first chamber to receive gases, the first chamber being in communication with the first arc quenching chamber via the first discharge opening and comprising a first aperture to exhaust to an exterior of the casing, the first aperture being provided with a first downstream filtering device, wherein:

the circuit breaker furthermore includes at least one second chamber to receive gases, the second chamber being in communication, independently of the first arc quenching chamber, with at least one second arc quenching chamber of another pole of the circuit breaker, via a second gas discharge opening of the second arc quenching chamber, the second arc quenching chamber being equipped with a second upstream device to filter gases, the second chamber to receive gases includes a second aperture to exhaust gases to the exterior of the casing, the second aperture being provided with a second downstream filtering device, and wherein each pole includes only one first arc quenching chamber that is in communication with only one second chamber.

2. The circuit breaker according to claim 1, wherein the second arc quenching chamber and the second chamber of each pole are fluidically separated from arc quenching chambers and second chambers of other poles by impermeable walls, each second chamber including a downstream gas filtering device, the aperture being distinct from gas exhausting apertures of the other gas receiving chambers of the circuit breaker.

3. The circuit breaker according to claim 2, wherein the downstream gas filtering device of each of said second chambers is distinct from the respective downstream gas filtering device of the other gas receiving chambers of the circuit breaker.

4. The circuit breaker according to claim 1, wherein the downstream gas filtering device includes a stack of a plurality of layers of rep fabric with different mesh aperture sizes, the layers of rep fabric being arranged in the stack in decreasing mesh aperture sizes, the layers of rep fabric positioned on the second chamber side having a mesh aperture size that is greater than a mesh aperture size of the layers of rep fabric in the stack that are positioned towards an outside of the circuit breaker.

5. The circuit breaker according to claim 4, wherein the layers of the stack of the downstream filtering device have a mesh aperture size of between 100 μm and 500 μm, the mesh aperture size being defined as being a hydraulic diameter of a mesh aperture of the rep fabric of the layer.

6. The circuit breaker according to claim 1, wherein each second chamber includes a cover attached to an air quenching chamber or chambers with which the receiving chamber is in fluidic communication, covering a corresponding gas discharge opening or openings, the cover being held in place on the casing with no degrees of freedom by fixing elements.

7. The circuit breaker according to claim 6, wherein the circuit breaker includes, for each second chamber, a sealing element placed between the cover and the casing.

8. The circuit breaker according to claim 7, wherein the sealing element is a flat gasket compressed between the cover and the casing.

* * * * *